US010214009B2

(12) United States Patent
McMullen et al.

(10) Patent No.: US 10,214,009 B2
(45) Date of Patent: Feb. 26, 2019

(54) INKJET PRINTHEAD

(71) Applicant: Xaar Technology Limited, Cambridge (GB)

(72) Inventors: Robert Errol McMullen, Cambridge (GB); James Edward David Marchant, Buckingham (GB); Subramanian Sivaramakrishnan, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 15/579,587

(22) PCT Filed: Jun. 3, 2016

(86) PCT No.: PCT/GB2016/051645
§ 371 (c)(1),
(2) Date: Dec. 4, 2017

(87) PCT Pub. No.: WO2016/193749
PCT Pub. Date: Dec. 8, 2016

(65) Prior Publication Data

US 2018/0170037 A1 Jun. 21, 2018

(30) Foreign Application Priority Data

Jun. 5, 2015 (GB) ..... 1509817.1

(51) Int. Cl.
*B41J 2/045* (2006.01)
*B41J 2/14* (2006.01)

(52) U.S. Cl.
CPC ..... *B41J 2/04541* (2013.01); *B41J 2/14233* (2013.01); *B41J 2002/14258* (2013.01); *B41J 2002/14491* (2013.01)

(58) Field of Classification Search
CPC ..... B41J 2/04541; B41J 2/14233; B41J 2002/14491; B41J 2002/14258
See application file for complete search history.

(56) References Cited

U.S. PATENT DOCUMENTS

2003/0227519 A1 12/2003 Ikeda et al.
2009/0002458 A1 1/2009 Furukawa et al.
(Continued)

FOREIGN PATENT DOCUMENTS

EP 1 384 583 A1 1/2004
EP 1 767 365 A1 3/2007
JP 2014-177049 A 9/2014

OTHER PUBLICATIONS

PCT International Search Report and Written Opinion; PCT/GB2016/051645; dated Sep. 27, 2016.
(Continued)

*Primary Examiner* — Lamson Nguyen
(74) *Attorney, Agent, or Firm* — Finnegan, Henderson, Farabow, Garrett & Dunner LLP

(57) ABSTRACT

An inkjet printhead comprising a printhead die, the printhead die comprising: a plurality of actuators; a plurality of electrical connections in electrical communication with respective first electrodes of the plurality of actuators for providing drive signals thereto; a first electrical bus arranged in common electrical communication with second electrodes of a first group of the actuators for providing first signals thereto; and a second electrical bus arranged in common electrical communication with second electrodes of a second group of the actuators for providing second signals thereto.

20 Claims, 9 Drawing Sheets

(56) References Cited

U.S. PATENT DOCUMENTS

| | | | |
|---|---|---|---|
| 2011/0273497 | A1 | 11/2011 | Yamamoto et al. |
| 2014/0240398 | A1 | 8/2014 | Yamashita |

OTHER PUBLICATIONS

UKIPO Search and Examination Report; GB 1509817.1; dated Dec. 8, 2015.

INKJET PRINTHEAD

CROSS-REFERENCE TO RELATED APPLICATIONS

This application is a US national phase of PCT/GB2016/051645 filed 2016 Jun. 3, which claims priority to United Kingdom Patent Application No. 1509817.1 filed 2015 Jun. 5, both of which are titled INKJET PRINTHEAD and the entire disclosures of which are herein incorporated by reference.

The invention relates to inkjet printheads, and particularly, but not exclusively, to arrangements of electrical connections provided thereon for driving actuators associated therewith.

Drop-on-demand inkjet printheads are known in the art, whereby, generally, a printhead die, hereinafter "die", comprises a plurality of fluidic chambers provided thereon, each fluidic chamber having an associated nozzle and individually addressable ejection mechanisms, whereby the ejection mechanisms provide for controlled ejection of ink from the nozzles in the form of ink droplets.

Inkjet printheads can generally be categorised into thermal inkjet printheads or piezoelectric inkjet printheads.

Thermal inkjet printheads use a thermal process to rapidly generate a bubble of ink vapour within a fluidic chamber, whereby the bubble causes ink to be ejected out through a nozzle of the fluidic chamber as ink droplets. Controlling the generation of the bubble of ink vapour allows for controlled deposition of such ink droplets onto a print medium.

Each fluidic chamber of a thermal inkjet printhead has an associated ejection mechanism in the form of a heater to generate the bubble of ink vapour, whereby each heater associated with the respective fluidic chambers can be individually controlled by a controller (e.g. a computer terminal) in electrical communication therewith.

In contrast to thermal inkjet printheads, piezoelectric inkjet printheads use mechanical displacement to effect controlled ejection of ink from a fluidic chamber.

Piezoelectric inkjet printheads generally comprise a plurality of fluidic chambers each having associated ejection mechanisms in the form of an actuating element, whereby the respective actuating elements are configured to deform in a controlled manner in response to a signal (e.g. ground/drive signals).

Controlled deformation of the respective actuating elements causes ink to be ejected from a nozzle of each of the associated fluidic chambers as ink droplets. The actuating elements may be provided in different configurations depending on the application. For example the actuating elements may be provided in roof mode or shared wall configurations.

It will be appreciated that each ejection mechanism for both the thermal and piezoelectric inkjet printheads will generally comprise at least two electrodes in electrical communication with a controller remote from the die. Therefore, electrical connections are required to connect the ejection mechanisms on the die to the controller.

In some configurations, the electrical connections will be provided as electrical traces or electrical tracks provided on the die, whereby, for example, an end of each electrical trace will be connected to an electrode of the ejection mechanisms, whilst an opposite end of each electrical trace will be connected to a further electrical connection(s) e.g. an electrical contact(s) (e.g. a pad/terminal/pin), for off-die connection to the controller.

A flexible circuit having a plurality of electrical connections (e.g. electrical traces) may be connected to the electrical contacts on the die to provide an off-die electrical connection, thereby providing electrical communication between each of the ejection mechanisms provided on the die and the controller located off-die. Such a configuration allows for individual addressing of the ejection mechanisms for control thereof, whereby drive and ground signals are provided to the respective electrodes of the ejection mechanisms from the controller, via the flexible circuit.

In many circumstances, application and market demands drive a need for higher resolution inkjet printheads. One solution for increasing the achievable resolution of an inkjet printhead is to increase the number of nozzles provided on a die.

However, increasing the number of nozzles per die also results in a corresponding increase in the number of actuators, electrodes, electrical connections required on the die.

As an illustrative example, a printhead die may comprise more than 1000 nozzles, whereby each nozzle has an associated ejection mechanism, and, as above, each ejection mechanism comprises two or more electrodes, which, in turn are in contact with two or more electrical traces to receive the signals from a controller. Therefore, the die of the illustrative example requires more than 2000 electrical traces and a substantially similar number of electrical contacts. Such a die requires a large area dedicated to electrical connections, which either poses engineering challenges due to spatial limitations or, if die size can be increased, an increase in cost.

Thermal inkjet printheads sometimes include CMOS (complementary metal-oxide-semiconductor) components provided on a single printhead die, thereby enabling a reduction in the number of electrical connections (e.g. off-die electrical connections) required for the die.

The use of CMOS in piezoelectric inkjet heads is more difficult to implement however, due to lead (Pb) contamination issues for lead-based actuator materials such as lead zirconium titanate (PZT), and/or high processing temperatures that may be greater than, for example, 700° C.' which are required to crystallise the piezoelectric material during the fabrication process of M EMS (Micro-Electro-Mechanical Systems) fabricated actuator components.

Therefore improving the resolution of piezoelectric inkjet printheads is becoming increasingly difficult using available packaging and off-die interconnection techniques.

In some cases, increasing the resolution of an inkjet printhead may also result in electrical crosstalk between electrical connections on the die due to an increase in the number of required electrical connections. It will be appreciated that electrical crosstalk may negatively affect the operation of the inkjet printhead.

The invention seeks to address the aforementioned problems.

In a first aspect there is provided an inkjet printhead comprising a printhead die, the printhead die comprising: a plurality of actuators; a plurality of electrical connections in electrical communication with respective first electrodes of the plurality of actuators for providing drive signals thereto; a first electrical bus arranged in common electrical communication with second electrodes of a first group of the actuators for providing first signals thereto; and a second electrical bus arranged in common electrical communication with second electrodes of a second group of the actuators for providing second signals thereto.

With such a configuration, current paths are only shared between actuators within the same group. Such a configuration provides for reduced distortion being generated in comparison to a configuration in which all actuators are connected to a common electrical bus, thereby providing for reduced electrical cross talk and reduced droplet placement error.

Preferably, the plurality of actuators are arranged in one or more rows extending in a length direction of the inkjet printhead die.

Preferably, each row comprises at least one group of actuators, wherein a group comprises alternate actuators of a row.

Preferably, the electrical traces provide the common electrical communication between the electrical buses and the second electrodes.

Preferably, the inkjet printhead die comprises three or more electrical buses, each electrical bus in electrical communication with a different group of actuators.

The number of electrical buses is not limited to first and second buses, and therefore, any suitable number of electrical buses may be arranged in common electrical communication with second electrodes of any suitable number of groups for providing signals thereto.

Preferably, the electrical buses are in electrical communication with a controller remote from the printhead die, wherein the controller is configured to provide signals to the electrical buses, wherein a flexible cable or flexible printed circuit provides electrical communication between the electrical buses on the printhead die and the controller.

Preferably, the electrical buses are electrically isolated from each other on the inkjet printhead die, Preferably, the electrical buses are provided in electrical communication with a common connection.

Furthermore, the electrical buses, which each have a resistance associated therewith can be electrically isolated from each other on the printhead die, and can be connected to a relatively low resistance conductor located off-die. In alternative configurations, the electrical buses may be coupled together on the die at an area of the die at which a relatively lower resistance connection may be provided.

Preferably, the common connection has a lower resistance than that of the electrical buses and wherein the common connection is provided at one of the following: the inkjet printhead die; the flexible printed cable or flexible printed circuit; or the controller.

Preferably, a drive circuit is arranged in electrical communication between the first electrodes and the controller and configured to receive control signals from the controller and to provide the drive signals in response to the control signals, and wherein the drive circuit comprises an application specific integrated circuit (ASIC).

Preferably, wherein the first signals are identical to the second signals, and wherein the first or second signals comprise ground signals.

The first and second signals may be substantially identical to each other, for example, when a ground signal is provided to both. However, the first and second signals may differ from each other, whereby one of the signals may have a different offset relative to the other. It will be appreciated that more than two signals may be provided.

In a second aspect there is provided a printhead die, for an inkjet printhead, the printhead die comprising: a plurality of actuators; a plurality of electrical connections in electrical communication with respective first electrodes of the plurality of actuators for providing drive signals thereto; a first electrical bus arranged in common electrical communication with second electrodes of a first group of the actuators for providing first signals thereto; and a second electrical bus arranged in common electrical communication with second electrodes of a second group of the actuators for providing second signals thereto.

Figure 3A:
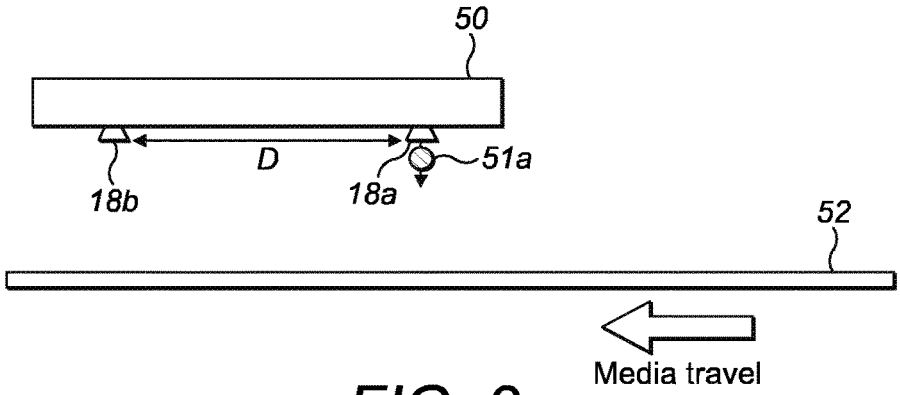
Figure 3B:
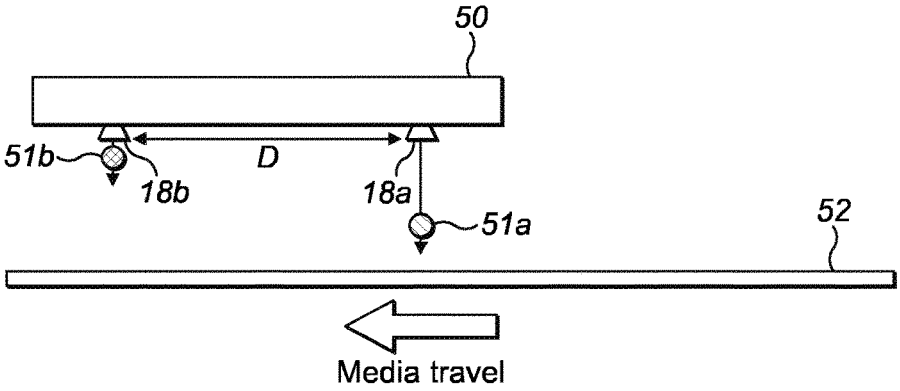

FIG. 3*a* is a schematic diagram showing the deposition process of ink droplets on a print medium according to an embodiment;

FIG. 3*b* is a schematic diagram further showing the deposition process of FIG. 3*a;*

Figure 3C:
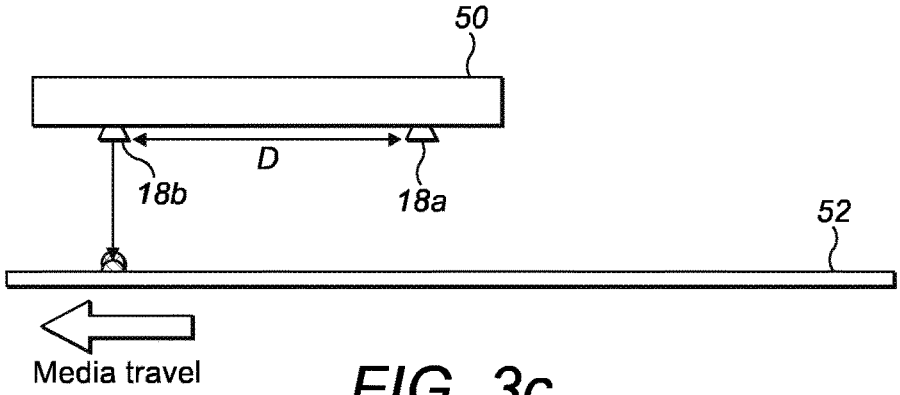

FIG. 3*c* is a schematic diagram further showing the deposition process of FIG. 3*a;*

Figure 1:
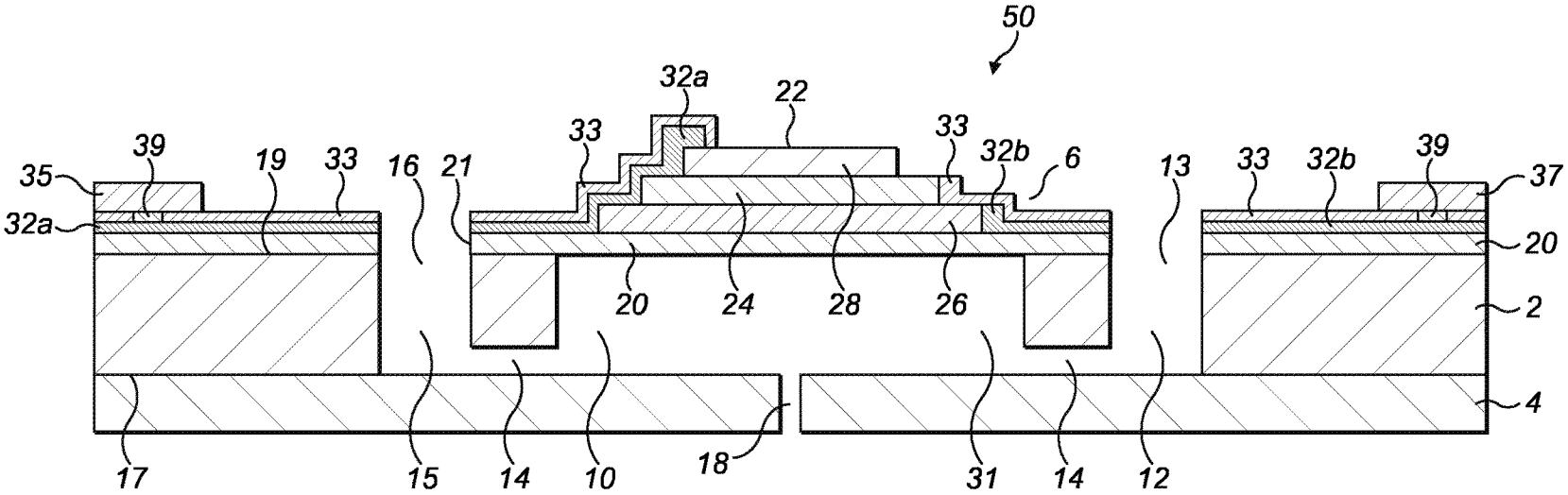
FIG. 1 is a schematic diagram showing a cross-section view of a portion of an inkjet printhead die.
Figure 4A:
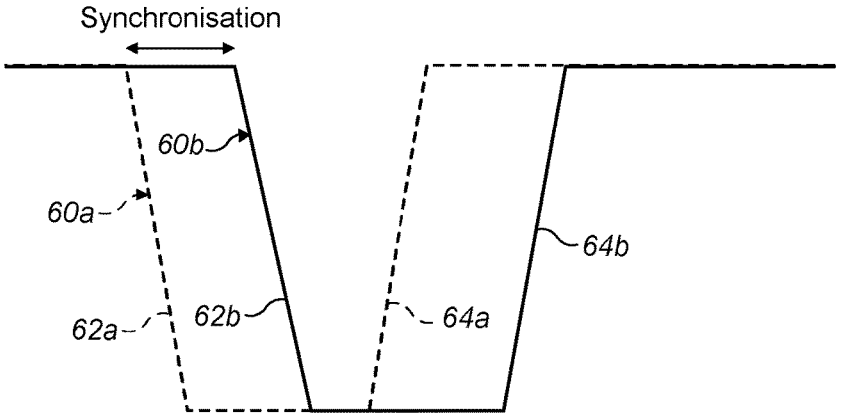
Figure 4B:
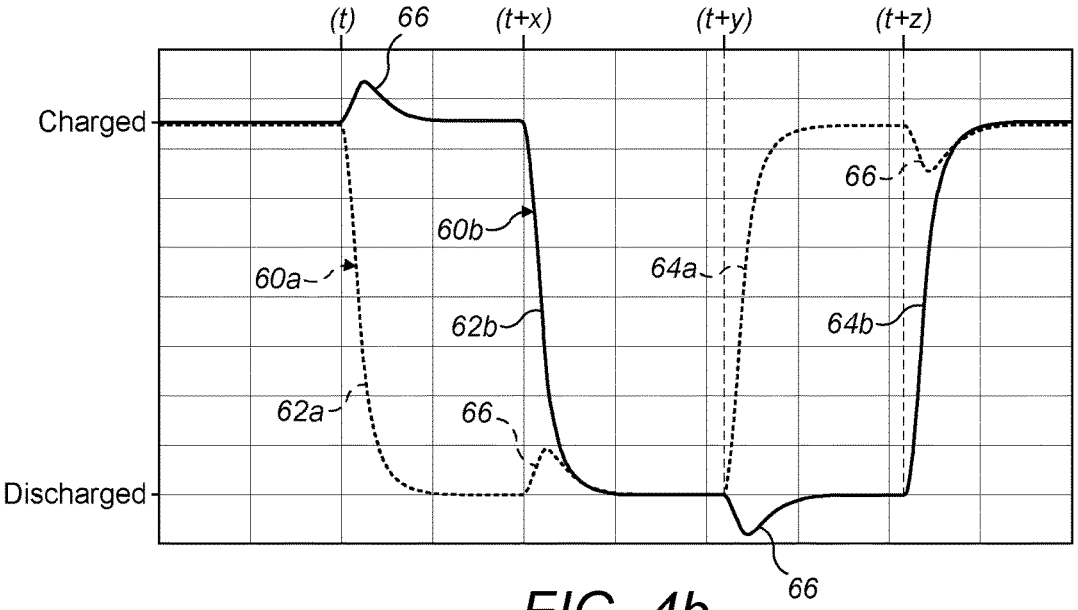
Figure 5A:
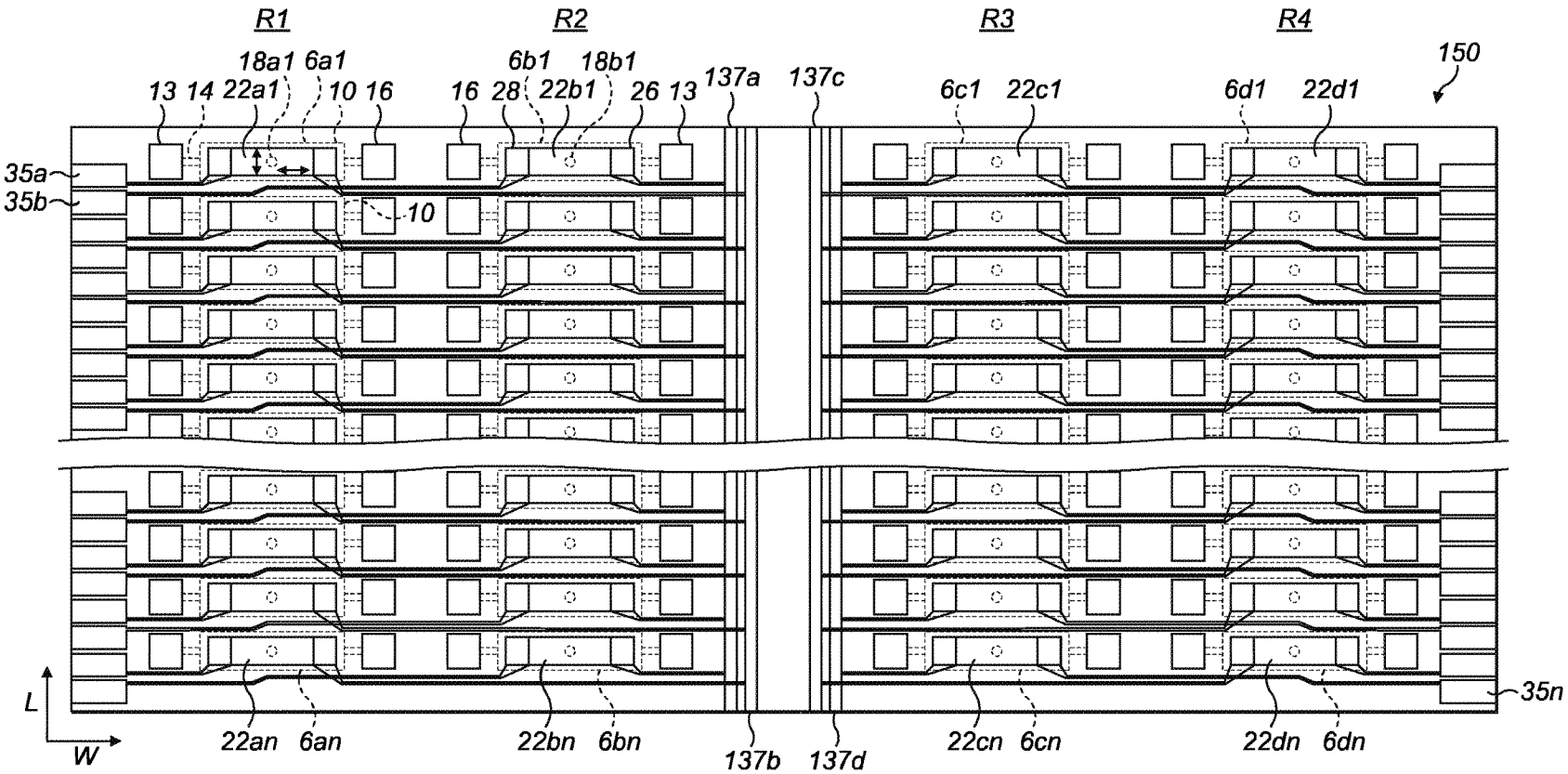
Figure 5B:
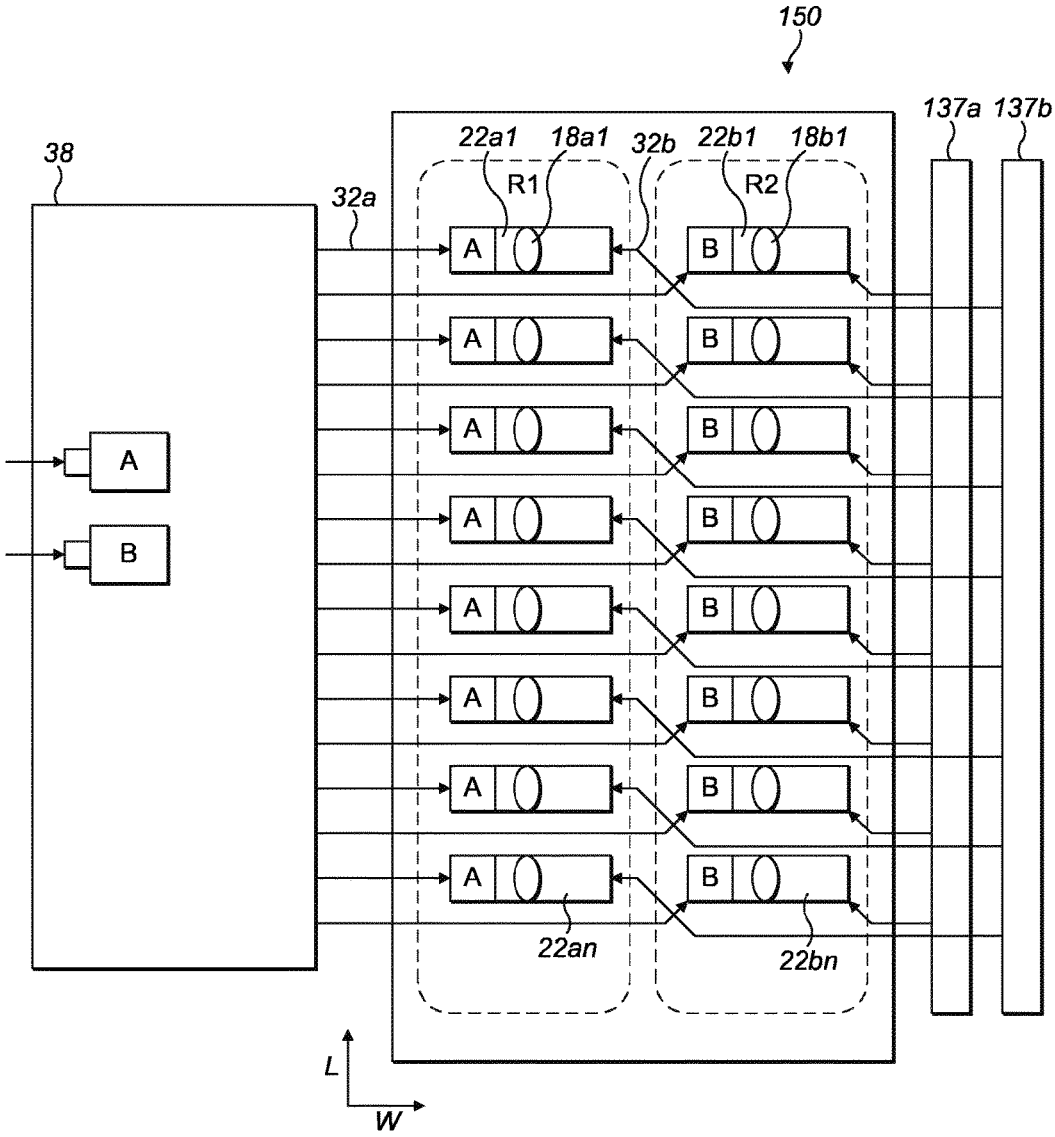

FIG. 4*a* is a schematic diagram showing example waveforms for driving actuators;

FIG. 4*b* is a schematic diagram showing example waveforms for driving actuators having a known circuit configuration;

FIG. 5*a* is a schematic diagram showing a top-down view of the inkjet printhead die of FIG. 1 having a circuit configuration for driving groups of actuators according to an embodiment;

FIG. 5*b* is a schematic diagram showing a circuit configuration for supplying signals to the groups of actuators of FIG. 5*a;*

Figure 6:
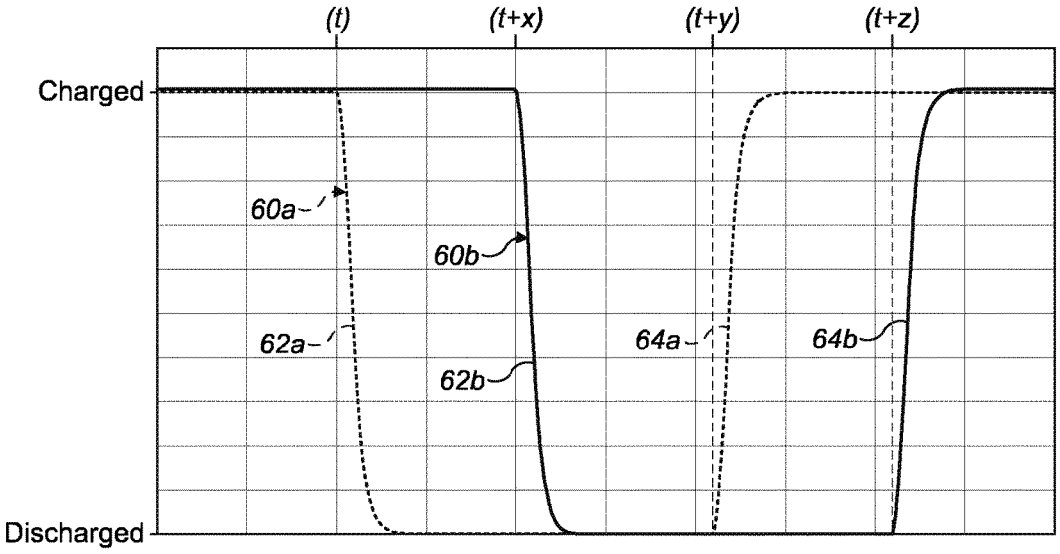

FIG. 6 is a schematic diagram showing an example waveform for driving one group of the group of actuators of FIG. 5*a;*

Figure 7A:
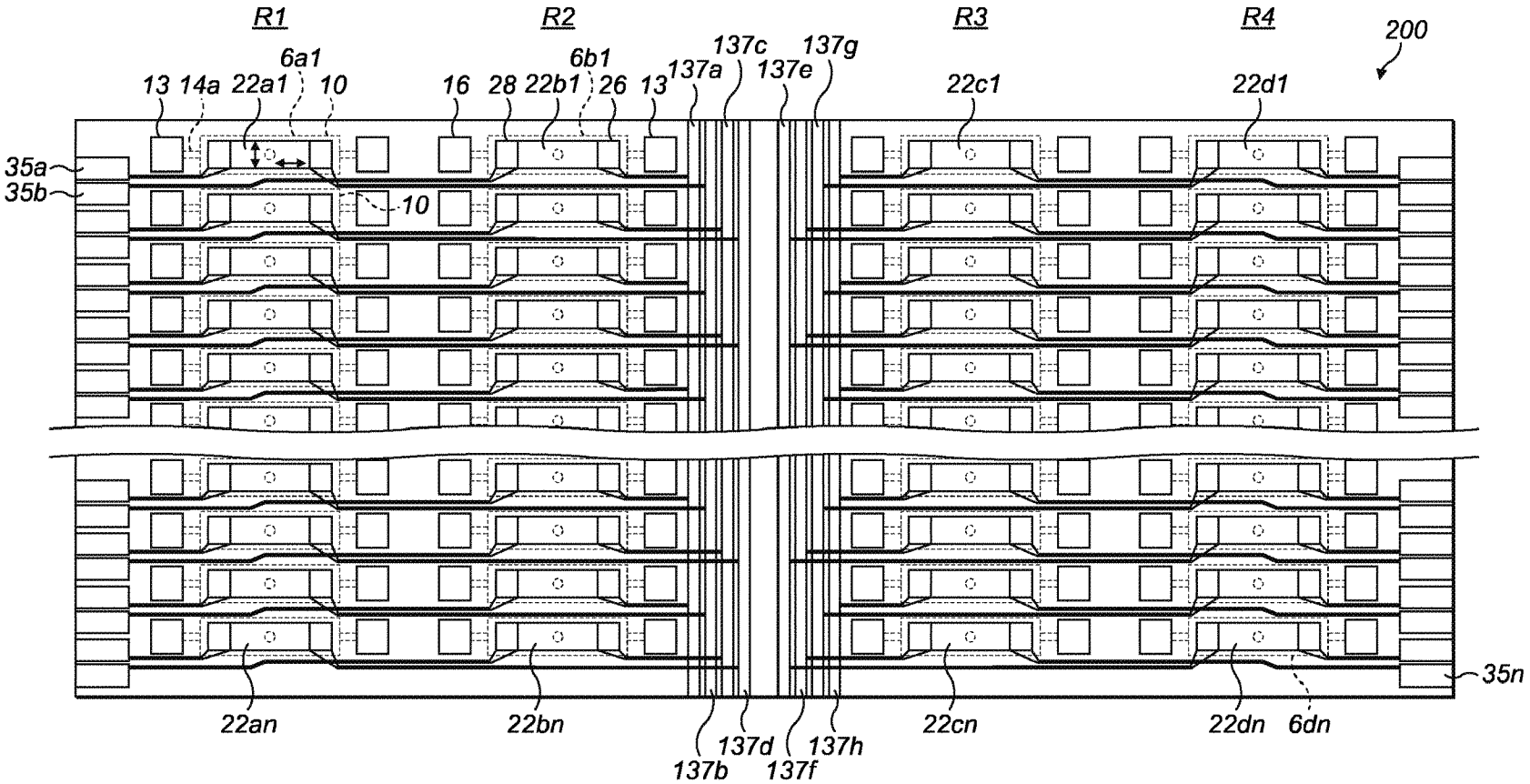
Figure 7B:
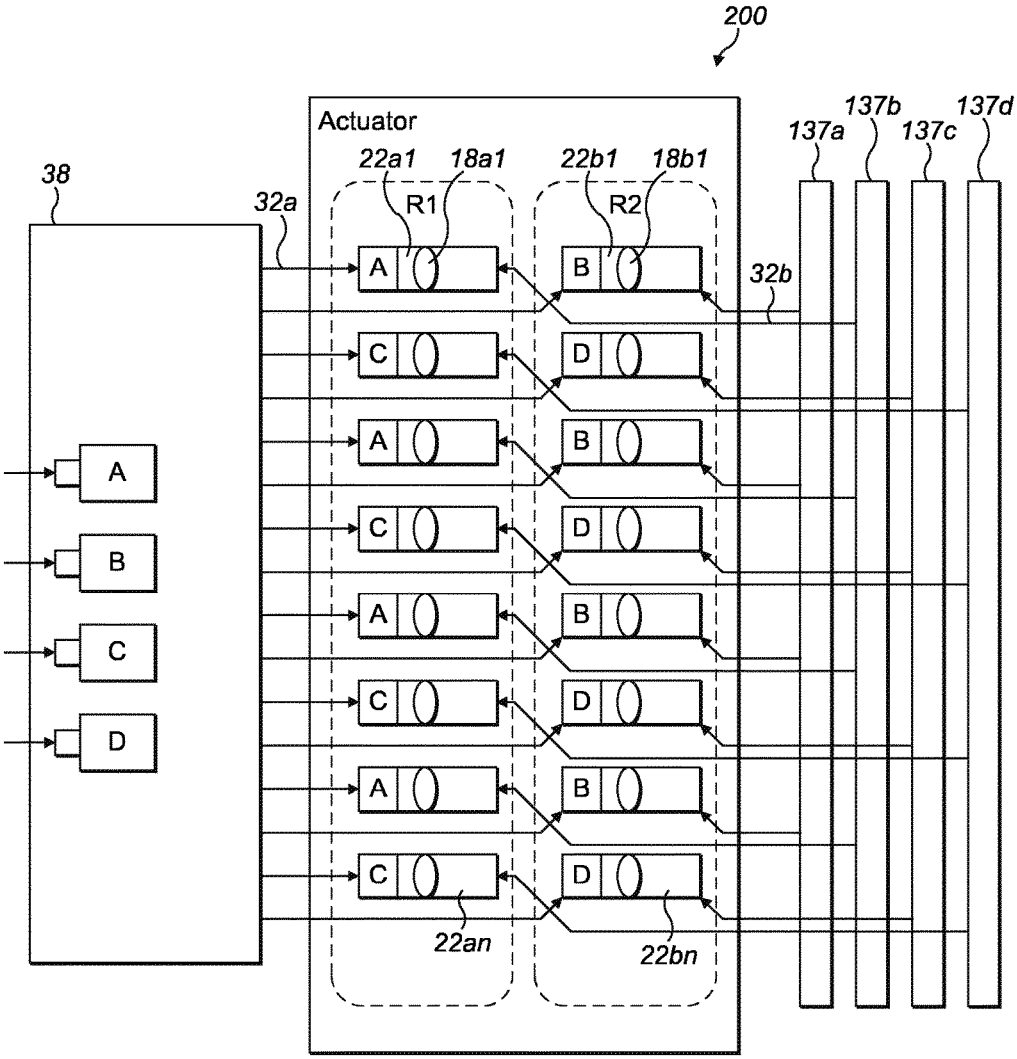

FIG. 7*a* is a schematic diagram showing a top-down view of the inkjet printhead die of FIG. 1 having a circuit configuration for driving groups of actuators associated therewith according to a further embodiment; and FIG. 7*b* is a schematic diagram showing a circuit configuration for supplying signals to the groups of actuators of FIG. 7*a.*

FIG. 1 is a schematic diagram showing a cross-section view of a portion of an inkjet printhead die 50 of an inkjet piezoelectric printhead having a known circuit configuration.

In the following description, the inkjet printhead is described as a thin film inkjet piezoelectric printhead, which has a thin film piezoceramic actuator and may be fabricated using any suitable fabrication process(es) or technique(s), such as those used to fabricate structures for CMOS and/or MEMS.

The inkjet printhead is not limited to being a thin film inkjet printhead, nor is the inkjet printhead limited to being fabricated using such processing techniques as described above. Instead, any other suitable fabrication process(es) may be used, such as, for example, machining a bulk piezoceramic actuator with a dicing saw and bonding it to the fluidic chamber.

The die 50 comprises a fluidic chamber substrate 2 and a nozzle layer 4.

The die 50 comprises a droplet generating unit 6, hereinafter "droplet unit". The die 50 may comprise a plurality of droplet units 6 arranged in arrays thereon as will be described below.

As shown in FIG. 1, the droplet unit 6 comprises a fluidic chamber 10 and a fluidic inlet port 13 in fluidic communication therewith via a fluidic supply channel 12.

The fluidic inlet port 13 is provided at a top surface 19 of the fluidic chamber substrate 2 towards one end of the fluidic chamber 10 along a length thereof.

In the present embodiment, fluid, hereinafter "ink", is supplied to the fluidic chamber 10 from the fluidic inlet port 13. In the present embodiment the droplet unit 6 further comprises a fluidic channel 14 provided within the fluidic chamber substrate 2 in fluidic communication with the fluidic supply channel 12 and fluidic chamber 10, and arranged to provide a path for ink to flow therebetween.

Furthermore, in the present example, the droplet unit 6 comprises a fluidic outlet port 16 in fluidic communication with the fluidic chamber 10, whereby ink may flow from the fluidic chamber 10 to the fluidic outlet port 16 via a fluidic channel 14 and fluidic return channel 15 formed in the fluidic chamber substrate 2.

In the present embodiment, the fluidic outlet port 16 is provided at the top surface 19 of the fluidic chamber substrate 2 towards an end of the fluidic chamber 10 opposite the end towards which the fluidic inlet port 13 is provided.

Alternatively, the fluidic inlet port 13 and/or fluidic outlet port 16 may be provided within the fluidic chamber 10.

Alternatively, ink may be supplied and/or returned via port(s) provided at the side(s) of the die.

An inkjet printhead comprising droplet units 6 having fluidic inlet ports 13 and fluidic outlet ports 16, whereby ink flows continuously from the fluidic inlet port 13 to the fluidic outlet port 16, along the length of the fluidic chamber 10 may be considered to operate in a recirculation mode.

In alternative embodiments, ink may be supplied to the fluidic chamber 10 from both fluidic ports 13 and 16 or whereby the die 50 is not provided with a fluidic outlet port 16 and/or fluidic return channel 15 such that substantially all of the ink supplied to the fluidic chamber 10 is ejected from the nozzle 18, whereby the inkjet printhead may be considered to operate in a non-recirculation mode.

The fluidic chamber substrate 2 may comprise silicon (Si), and may, for example, be manufactured from a Si wafer, whilst the associated features, such as the fluidic chamber 10, fluidic channels 12/15, fluidic inlet/outlet ports 13/16 and fluidic channels 14 may be formed using any suitable fabrication process, e.g. an etching process, such as deep reactive ion etching (DRIE) or chemical etching.

Additionally or alternatively, the associated features of the fluidic chamber substrate 2 may be formed from an additive process e.g. a chemical vapour deposition (CVD) technique (for example, plasma enhanced CVD (PECVD)), atomic layer deposition (ALD), or the features may be formed using a combination of removal and/or additive processes.

In the present example, the nozzle layer 4 is provided at a bottom surface 17 of the fluidic chamber substrate 2, whereby "bottom" is taken to be a side of the fluidic chamber substrate 2 having the nozzle layer 4 thereon. It will be appreciated that the nozzle layer may be provided on a different surface other than the bottom surface.

The surfaces of various features of the die 50 may be coated with protective or functional materials, such as, for example, a suitable coating of passivation material or wetting material.

The droplet unit 6 further comprises a nozzle 18 in fluidic communication with the fluidic chamber 10, whereby the nozzle 18 is formed in the nozzle layer 4 using any suitable process e.g. chemical etching, DRIE, laser ablation etc.

The droplet unit 6 further comprises a vibration plate 20, provided at the top surface 19 of the fluidic chamber substrate 2, and arranged to cover the fluidic chamber 10. The top surface 19 of the fluidic chamber substrate 2 is taken to be the surface of the fluidic chamber substrate 2 opposite the bottom surface 17.

The vibration plate 20 is deformable to generate pressure fluctuations in the fluidic chamber 10, so as to change the volume within the fluidic chamber 10, such that ink may be ejected from the fluidic chamber 10 via the nozzle 18, e.g. as a droplet, and/or for drawing ink into the fluidic chamber e.g. via the fluidic inlet port 13.

The vibration plate 20 may comprise any suitable material, such as, for example a metal, an alloy, a dielectric material and/or a semiconductor material. Examples of suitable materials include silicon nitride ($Si_3N_4$), silicon dioxide ($SiO_2$), aluminium oxide ($Al_2O_3$), titanium dioxide ($TiO_2$), silicon (Si) or silicon carbide (SiC). The vibration plate 20 may additionally or alternatively comprise multiple layers.

The vibration plate 20 may be formed using any suitable processing technique, such as, for example, ALD, sputtering, electrochemical processes and/or a CVD technique. When the vibration plate 20 is provided on the top surface 19, apertures 21 corresponding to the fluidic ports 13/16 may be provided in the vibration plate 20, e.g. using a suitable patterning technique for example during the formation of the vibration plate 20.

The droplet unit 6 further comprises an actuator 22 provided on the vibration plate 20, which is arranged to deform the vibration plate 20, such that the inkjet printhead operates in roof mode.

However, any suitable type of aperture location, actuator or electrode configuration capable of effecting droplet generation may be used. For example inkjet printheads operating in a shared-wall configuration may be used, whereby the actuators are located within the respective fluidic chambers and the apertures are located in one of the surfaces bounding the chambers.

The actuator 22 is depicted as a piezoelectric actuator 22 comprising a piezoelectric element 24 provided with two electrodes 26 and 28. The piezoelectric element 24 may, for example, comprise lead zirconate titanate (PZT), however any suitable material may be used.

An electrode is provided in the form of a lower electrode on the vibration plate 20. The piezoelectric element 24 is provided on the lower electrode 26 using any suitable deposition technique. For example, a sol-gel deposition technique may be used to deposit successive layers of piezoelectric material to form the piezoelectric element 24 on the lower electrode 26, or the piezoelectric element 24 may be formed using any suitable technique.

A further electrode in the form of an upper electrode 28 is provided on the piezoelectric element 24 at the opposite side of the piezoelectric element 24 to the lower electrode 26, however any suitable configuration of the electrodes could be used.

The electrodes 26/28 may comprise any suitable material e.g. iridium (Ir), ruthenium (Ru), platinum (Pt), nickel (Ni) iridium oxide ($Ir_2O_3$), $Ir_2O_3$/Ir and/or gold (Au). The electrodes 26/28 may be formed using any suitable technique, such as a sputtering technique.

The electrodes 26/28 and the piezoelectric element 24 may be patterned separately or in the same processing step to define the actuator 22.

When a voltage differential is applied between the electrodes 26/28, a stress is generated in the piezoelectric element 24, causing the piezoelectric actuator 22 to deform on the vibration plate 20. This deformation changes the volume within the fluidic chamber 10 and ink droplets may be discharged from the nozzle 18 by driving the piezoelectric actuator 22 with an appropriate signal. The signal may be supplied from a controller (not shown), for example, as a voltage waveform. The controller may comprise a power amplifier or switching circuit connected to a computer running an application which generates signals in response to print data provided thereto e.g. uploaded thereto by a user.

Further material/layers (not shown) may also be provided in addition to the electrodes 26/28 and piezoelectric elements 24 as required.

A wiring layer comprising electrical connections is provided on the vibration plate 20, whereby the wiring layer may comprise two or more electrical traces 32*a*/32*b* for example, to connect the upper electrode 28 and/or lower electrode 26 of the piezoelectric actuator 22 to the controller, directly or via further drive circuitry.

For example, as schematically depicted in FIG. 1, the electrical trace 32*a* and the top electrode 28 are in electrical communication with a first electrical connection 35 in the form of an electrical contact (e.g. a drive contact), whilst the electrical trace 32*b* and the bottom electrode 26 are in electrical communication with a second electrical connection in the form of an electrical contact 37 (e.g. a ground contact). The electrical contacts 35/37 are, in turn, in electrical communication with the controller (not shown).

Using such a configuration, signals (e.g. a voltage waveform) can be supplied to the piezoelectric actuator 22 from the controller for controlled driving thereof.

The electrical traces 32*a*/32*b* comprise a conductive material, e.g. copper (Cu), gold (Ag), platinum (Pt), iridium (Ir), aluminium (Al), titanium nitride (TiN). The electrical traces 32*a*/32*b* may, for example, have a thickness of between 0.01 μm to 2 μm, and, in some embodiments, the thickness may be between 0.1 μm and 1 μm, and in further embodiments the thickness may be between 0.3 μm and 0.7 μm.

The wiring layer may comprise further materials (not shown), for example, a passivation material 33 to protect the electrical traces 32*a*/32*b* e.g. from the environment and from contacting the ink.

Additionally or alternatively, the passivation material 33 may comprise a dielectric material provided to electrically insulate electrical traces 32*a*/32*b* from each other e.g. when stacked atop one another or provided adjacent each other.

The passivation material may comprise any suitable material, for example: $SiO_2$, $Al_2O_3$ or $Si_3N_4$.

The wiring layer may further comprise adhesion materials (not shown) to provide improved bonding between, for example, the electrical traces 32*a*/32*b*, the passivation material 33, the electrodes 26/28 and/or the vibration plate 20.

FIG. 1 is a schematic diagram, and the electrical contacts 35/37 may be deposited on the inkjet printhead die 50 using any suitable technique and in any suitable configuration. The electrical contacts 35/37 may take the form of bond pads, traces or terminal pins formed of a conductive material e.g. copper (Cu), gold (Au), platinum (Pt), aluminium (Al) etc.

Furthermore the electrical contacts 35/37 may be deposited atop the passivation material 33, whereby electrical vias 39 provide electrical communication between the electrical contacts 35/37 and the electrical traces 32*a*/32*b*. Alternatively, the contacts may, for example, be provided directly atop the electrical traces. Although not explicitly described, further materials may be provided within the wiring layer to prevent unwanted electrical contact between the electrical traces 32*a*/32*b* and other materials as required.

The materials within the wiring layer (e.g. the electrical traces, passivation material, adhesion material and/or electrical contacts etc.) may be provided using any suitable fabrication technique such as, for example, a deposition/machining technique e.g. sputtering, CVD, PECVD, ALD, laser ablation etc. Furthermore, any suitable patterning technique may be used as required (e.g. providing a mask during sputtering and/or etching).

The inkjet printhead die 50 may comprise a plurality of droplet units 6. Therefore, the fluidic chamber substrate 2 comprises partition walls 31 provided between each of the droplet units 6 along the length direction thereof.

The inkjet printhead die 50 may comprise further features not described herein. For example, a capping substrate (not shown) may be provided atop the fluidic chamber substrate 2, for example at the top surface 19, the vibration plate 20 and/or the wiring layer to cover the piezoelectric actuator 22 and to further protect the piezoelectric actuator 22. The capping substrate may further define fluidic channels for supplying ink to the fluidic inlet ports 13 e.g. from an ink reservoir and for receiving ink from the fluidic outlet port 16, whereby the capping substrate may also function as an ink manifold.

Figure 2:
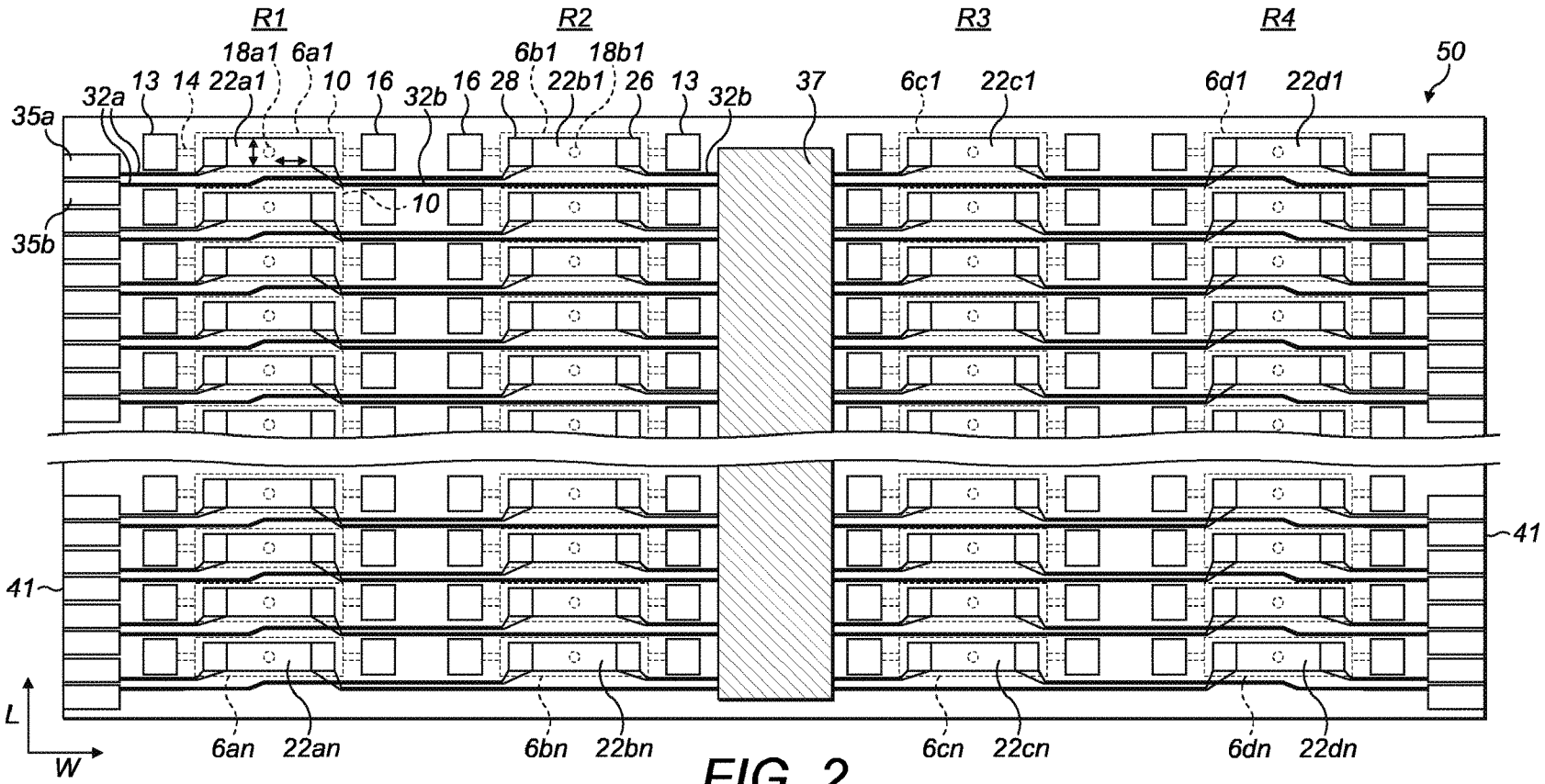
FIG. 2 is a schematic diagram showing a top-down view of the inkjet printhead die of FIG. 1 having a known circuit configuration for driving actuators associated therewith.

FIG. 2 is a schematic diagram showing a top-down view of the inkjet printhead die 50 having a known circuit configuration comprising electrical connections. Like reference numerals are used to describe like features as appropriate.

In the illustrative example, a plurality of droplet units 6*a*1-6*dn* are provided in four adjacent rows (R1-R4) on the inkjet printhead die 50, whereby the rows (R1-R4) extend in a length direction of the printhead die 50, between two opposing sides 41 thereof.

An electrical connection 37, in the form of a single central bus, is provided between the inner adjacent rows R2 and R3 along a central portion of the printhead die 50.

A plurality of electrical connections, for example, electrical traces 32*b* are arranged to extend between the respective lower electrodes 26 of the individual actuators 22*a*1-22*dn* and the central bus 37 to provide electrical communication therebetween.

Such a configuration allows for each of the lower electrodes of the respective actuators 22*a*1-22*dn* to be provided with a common signal (e.g. a ground signal) via the central bus 37.

Furthermore, electrical connections, shown as discrete electrical contacts 35 in the present example, are provided on the inkjet printhead die 50 along the opposing sides 41 thereof, whereby a plurality of electrical connections, for example, electrical traces 32*a* are arranged to extend between the individual upper electrodes 28 of the individual actuators 22*a*1-22*dn* and the discrete electrical contacts to provide electrical communication therebetween. Such a configuration allows for each of the upper electrodes of the respective actuators 22*a*1-22*dn* to be individually addressed via the discrete electrical contacts.

The arrangement of the electrical traces between the upper and lower electrodes may be alternated such that the central bus 37 may be arranged in electrical communication with the upper electrodes of the respective actuators 22*a*1-22*dn*, whilst the discrete electrical contacts may be arranged in electrical communication with the lower electrodes of the respective actuators 22*a*1-22*dn*. Furthermore, the electrodes of each actuator may not be formed on upper and lower surfaces but on the same surface.

A further electrical connection (not shown), such as one or more flexible cable or flexible printed circuit (FPC), may be provided between a controller (not shown) and the inkjet printhead and/or inkjet printhead die 50 for driving the actuators 22*a*1-22*dn* via the central bus 37 and the discrete electrical contacts 35.

The flexible cable may carry any required signals such as, but not limited to: drive signals, power signals, ground signals, sensor output signals and/or heater power signals.

In an example, ground signals are provided to the central bus 37 in common electrical communication with the lower electrodes 26 of the actuators 22*a*1-22*dn* whilst digital control signals are provided to drive circuitry on the printhead die 50 (not shown in FIG. 2), such as an ASIC, whereby the control circuitry provides drive signals to the respective actuators 22*a*1-22*dn*.

For example, the flexible cable may carry power signals processed by one or more ASICS (application specific integrated circuit) at the inkjet printhead to provide drive signals to the actuators on the inkjet printhead die 50, whilst a the flexible cable may carry the ground signals directly to the inkjet printhead die 50.

Such a configuration enables each of the actuators 22*a*1-22*dn* to be driven by the controller to generate ink droplets in a controlled manner.

As above, in the present example, the electrical contacts 35 are provided in two rows on the inkjet printhead die 50 along two opposing sides 41 thereof, arranged outside the outer rows (R1-R4). However, any suitable arrangement for positioning the electrical contacts 35 may be provided. For example, the electrical contacts 35 may be arranged along all sides of the printhead die 50.

When driving actuators of different rows to print onto a print medium moving relative to the inkjet printhead die (or wherein the inkjet printhead die and/or the print medium are moving relative to each other), the actuators are required to be carefully controlled to generate and eject droplets and precisely place the droplets on the print medium to obtain images and characters thereon.

Whilst the precision of droplet placement on a moving medium may be affected by different factors, some factors which influence droplet placement on a moving print medium include:

i) the distance between nozzles of droplet units in different rows; and ii) the speed/velocity at which the droplets travel from the nozzles to the print medium.

FIGS. 3*a*-3*c* are schematic diagrams showing the deposition of ink droplets 51*a* and 51*b* from nozzles 18*a* and 18*b* of adjacent rows R1 and R2 onto a print medium 52 moving relative to the inkjet printhead die 50.

In FIGS. 3*a*-3*c* only two nozzles 18*a* and 18*b* are schematically depicted for illustrative purposes.

The two nozzles 18*a* and 18*b* are separated by a distance (D). To maximise the resolution of an image/characters formed on the print medium 52, it is generally required to generate the droplets in a controlled manner, so as to control the precision of the placement of the droplets on the print medium 52.

In FIGS. 3*a*-3*c*, droplets ejected from the nozzles 18*a* and 18*b* at the same time using the same waveform will be separated on the print medium 52 by a distance substantially equal to the distance (D) between the nozzles 18*a* and 18*b*.

To place droplets generated by the nozzles 18*a* and 18*b* on the print medium at specific points thereon, the actuators of the respective droplet units are driven with waveforms having specific characteristics.

For example, as illustrated in FIGS. 3*a*-3*c*, to provide the droplets on the surface of the print medium 52 along the same axis substantially perpendicular to the direction of travel of the print medium 52, a first droplet 51*a* is ejected from the nozzle 18*a* towards the print medium 52 at a time (t) (e.g. using a first waveform), whereby the first droplet 51*a* lands on the print medium 52 and is carried along thereby.

At a time (t+a) after the ejection of the first droplet 51*a*, a second droplet 51*b* is controllably ejected from the nozzle 18*b* towards the print medium 52 (e.g. using a second waveform identical to the first waveform).

The second droplet 51*b* also lands on the print medium 52 at a time substantially equal to (t+a) after the first droplet 51*a* lands on the print medium 52.

Whilst the first and second waveforms described above are identical, the characteristics of the waveforms may be varied to achieve precise droplet placement e.g. by altering: voltage level, rise & fall slopes, pulse width, pulse duration, the time of the on pulse and/or pulse timing etc.

A representative ideal waveform for achieving precise droplet placement from the nozzles 18*a* and 18*b* is shown in FIG. 4*a*, whereby two voltage waveforms 60*a* and 60*b* have characteristics operable to effect controlled ejection of droplets from the nozzles 18*a* and 18*b* (of FIGS. 3*a*-3*c*) respectively.

For example, in the illustrative example, the actuator used to generate droplet 51*a* is driven by voltage waveform 60*a*, whilst the actuator used to generate droplet 51*b* is driven by voltage waveform 60*b*.

In the present illustrative examples, the voltage waveforms 60*a* and 60*b* each comprise a falling slope (depicted as 62*a* and 62*b* respectively) e.g. for causing one droplet of ink to be ejected from the corresponding nozzle. The respective voltage waveforms 60*a* and 60*b* also comprise a rising slope (depicted as 64*a* and 64*b* respectively), e.g. for effecting the drawing of ink into an associated fluidic chamber from an ink supply line.

A time delay, or offset, between the waveforms 60*a* and 60*b* provides for synchronisation between droplets from adjacent rows R1 and R2, landing on the print medium moving relative thereto and, advantageously provides a reduction in fluidic crosstalk between actuators in the same row. In addition, individual waveform adjustment for each actuator may be provided to adjust for non-uniformity between nozzles of the same row.

The voltage waveforms 60*a* and 60*b* are representative of ideal waveforms used to drive an actuator to effect droplet ejection from a corresponding nozzle. Waveforms having different characteristics may also be used to drive actuators e.g. having different rising and/or falling slopes and/or having different shapes (e.g. with different levels, multiple peaks).

As the speed of the print medium 52 moving relative to the inkjet printhead die 50 increases, the actuators are in turn required to be driven at increasing frequencies (e.g. from 30 kHz-300 kHz), which can result in an overlap of the respective waveforms of adjacent actuators in adjacent rows, whereby the adjacent actuators are being driven substantially at the same time (as illustratively shown in FIGS. 4*a* & 4*b*).

As such, when electrical connections (e.g. carrying drive signals, ground connections) are shared between the adjacent actuators being driven by overlapping waveforms, electrical crosstalk may occur across the shared electrical connections. It will also be appreciated that electrical crosstalk may result in distortion of the waveform, which in turn may affect the performance of the printhead.

FIG. 4*b* schematically shows waveforms 60*a* and 60*b* demonstrating the voltage measured across two actuators of adjacent rows of the inkjet printhead die 50 when being driven by respective drive waveforms. For the present example, the driving of the actuators 22*a*1 and 22*b*1 of droplet units 6*a*1 and 6*b*1 of FIG. 2 is illustratively described.

In the present illustrative example, drive signals are provided to the respective actuators 22*a*1 and 22*b*1 from electrical contacts 35*a* and 35*b* respectively, whilst ground signals are provided from the central bus 37.

To effect droplet ejection from the nozzle 18*a*1 of droplet unit 6*a*1, a charged actuator 22*a*1 is discharged at time (t) when being addressed by the falling slope 62*a* of waveform 60*a* and relaxes to its original state.

At (t+y) the actuator 22*a*1 starts to be charged and starts to be charged to its charged state (as before time (t)) by being addressed by the rising slope 64*a* of waveform 60*a* such that the actuator 22*a*1 deforms.

Similarly, to effect droplet ejection from the nozzle 18*b*1 of droplet unit 6*b*1, the actuator 22*b*1 is discharged at time (t+x) when being addressed by the falling slope 62*b* of waveform 60*b*, whilst at (t+z) the actuator 22*b*1 starts to be charged to its charged state (as before time (t+x)) by being addressed by the rising slope 64*b* of waveform 60*b* such that it deforms.

In the known circuit configuration described in FIG. 2, currents for the charging/discharging of all actuators 22*a*1-22*dn* pass through the central bus 37 which is common to all actuators and provides a current path.

The current path provided by the central bus 37 has a finite resistance. As such the central bus 37 may be represented as a resistor having a finite resistance, whereby a voltage is generated across the central bus 37 as currents travel along the central bus 37 due to charging/discharging of the actuators 22*a*1-22*dn*. The voltage across the central bus 37 is added to the voltage across the actuators which causes a distortion 66 as illustratively shown on the waveforms 60*a*/60*b*.

The distortion 66 may, for example, affect the characteristics of the ejected droplets, such as velocity and/or volume, which in turn may disadvantageously result in droplet placement errors and compromised image quality.

FIG. 5*a* is a schematic diagram showing a top-down view of inkjet printhead die 150 having a circuit configuration according to an embodiment of the invention, whilst FIG. 5*b* schematically shows a circuit configuration for driving different groups of actuators (A & B) of inkjet printhead die 150.

Like numbering used previously will be used to describe like features as appropriate.

In the present embodiment, the inkjet printhead die 150 is provided with droplet units 6*a*1-6*dn* and arranged in four rows (R1-R4), as described above in relation to the inkjet printhead die of FIG. 2.

The inkjet printhead die 150 comprises multiple contacts 35*a*-35*n* arranged to provide signals (for example drive signals) to the first electrodes 28 of the respective actuators 22*a*1-22*dn* via electrical traces 32*a*. Second electrodes 26 of the actuators 22*a*1-22*dn* are connected to electrical connections 137*a* or 137*b* via electrical traces 32*b*.

Therefore, in contrast to the inkjet printhead die described in FIG. 2 which comprises only a single electrical connection 37 in common electrical communication with the second electrodes of all actuators provided thereon, the inkjet printhead die 150 of the present embodiment comprises multiple electrical connections, electrically isolated from each other, which are depicted as electrical buses 137*a*-137*d*.

In the illustrative example of FIG. 5*a*, four electrical buses 137*a*-137*d* arranged between four rows R1-R4, extend in the direction of the rows between the inner rows R2 & R3 of droplet units 6*b*1-6*cn*. It will be understood that the electrical buses 137*a*-137*d* are not limited to this particular configuration, and may be arranged in any suitable configuration to provide electrical communication with the respective second electrodes 26.

Providing separate electrical buses allows for the actuators 22*a*1-22*dn* to be grouped, such that each group may be provided in common electrical communication with a different electrical bus, whereby a controller (not shown) and/or drive circuit 38 (not shown in FIG. 5*a*), may be used to provide the respective drive/ground signals to the actuators 22*a*1-22*dn* of the different groups.

In the present embodiment, each group comprises the actuators of a respective row. For illustrative purposes, the different groups are labelled as A & B in FIG. 5*b*, whereby each of the electrical buses is in common electrical communication with a respective group of actuators. As depicted in FIG. 5*b*, the electrical bus 137*a* is in common electrical communication with the second electrodes 26 of the actuators of row R2 (Group B); whilst electrical bus 137*b* is in common electrical communication with the second electrodes 26 of the actuators of row R1 (Group A).

The arrangement of the electrical traces between the first and second electrodes may be alternated such that the electrical buses may be arranged in electrical communication with the first electrodes of the respective actuators, whilst the discrete electrical contacts may be arranged in electrical communication with the second electrodes of the respective actuators.

The electrical buses may take any suitable form. For example, the electrical buses 137*a*-137*d* may comprise traces of conductive material deposited on the surface of the inkjet printhead die 150, such that a suitable etching and deposition process may provide electrical communication between the electrical traces 32*b* and the electrical buses e.g. using vias.

Alternatively, the electrical buses may be provided within a flexible cable, whereby an anisotropic conductive adhesive (ACA) (e.g. an anisotropic conductive film (ACF) or an anisotropic conductive paste (ACP)), is provided on the electrical traces 32*b* to provide electrical communication between the electrical traces 32*b* and the respective electrical buses.

Drive signals can be provided to individual actuators of the different groups from the drive circuit 38 (FIG. 5*b*), which in turn receives the drive signals from a controller. The drive signals received by the drive circuit 38 from the controller may be modified at the drive circuit 38 before being provided to the actuators 22*a*1-22*dn*.

For example, the drive circuit 38 may comprise an ASIC, which is operable to receive drive signals from a controller, modify the signals (e.g. split the signals), and communicate the modified signals to the respective actuators 22*a*1-22*dn* via the electrical contacts.

Furthermore, each electrical bus 137*a*-137*d* may be used to provide a separate current path for the actuators of the respective groups. Furthermore still, different signals may be provided to the actuators of the different groups via the electrical buses 137*a*-137*d*.

For the circuit configurations illustrated in FIGS. 5*a* and 5*b*, whilst the actuators of a particular group are arranged in common electrical communication with the same electrical bus, actuators of different groups will be not be in common electrical communication with the same electrical bus or with each other. Therefore, the electrical buses 137*a*-137*d* are not shared between actuators of the different groups.

With such a configuration, current paths are only shared between actuators within the same group.

Such a configuration provides for reduced distortion being generated in comparison to that of a common electrical bus as described in FIG. 2 above, resulting in reduced electrical cross talk and reduced droplet placement error.

In the present embodiment, the electrical buses 137*a-d* can be connected/coupled to a relatively low resistance conductor located off-die, so as to further reduce signal distortion. For example, the electrical buses 137*a*-137*d* can be maintained in electrical isolation from each other on the printhead die 150, whereby they may be connected to each other at a controller, or flexible cable, remote from the printhead die 150.

Alternatively, the electrical buses may be maintained in electrical isolation from each other at all times, whereby, for example, the electrical buses may be supplied with different signals from the same or different controllers.

As an illustrative example of the reduced distortion, FIG. 6 schematically shows waveforms 60*a* and 60*b* demonstrating the voltage measured across two actuators of adjacent rows of the inkjet printhead die 150 when being driven by respective drive waveforms. For the present example, the driving of the actuators 22*a*1 and 22*b*1 of droplet units 6*a*1 and 6*b*1 of FIGS. 5*a* and 5*b* is illustratively described.

Drive signals are provided to the respective actuators 22*a*1 and 22*b*1 from electrical contacts 35*a* and 35*b* respectively, whilst the ground signal for the actuator 22*a*1 of group A is provided via the electrical bus 137*b*, and the ground signal for the actuator 22*b*1 of group B is provided via the electrical bus 137*a*.

To effect droplet ejection from the nozzle 18*a*1 of droplet unit 6*a*1, a charged actuator 22*a*1 is discharged at time (t) when being addressed by the falling slope 62*a* of waveform 60*a* and relaxes to its original state. As above in FIG. 4*b*, at (t+y) the actuator 22*a*1 starts to be charged to its charged state (as before time (t)) by being addressed by the rising slope 64*a* of waveform 60*a*.

Similarly, to effect droplet ejection from the nozzle 18*b*1 of droplet unit 6*b*1, the actuator 22*b*1 is discharged at time (t+x) when being addressed by the falling slope 62*b* of waveform 60*b*, whilst at (t+z) the actuator 22*b*1 starts to be charged to its charged state (as before time (t+x)) by being addressed by the rising slope 64*b* of waveform 60*b*.

As depicted in FIG. 6, for each charge/discharge, a corresponding distortion is reduced in comparison to the configuration comprising a common electrical bus shared by all actuators. As above, such a reduction is achieved by, for example, providing two or more electrical buses in electrical communication with respective groups of actuators on the printhead die. The reduction may also be achieved by maintaining electrical separation between the two or more electrical buses on the printhead die, whereby the electrical buses may be connected together off the printhead die with a connection having a lower resistance in comparison to the electrical buses on the printhead die.

FIG. 7*a* is a schematic diagram showing a top-down view of inkjet printhead die 200 having a circuit configuration according to a further embodiment of the invention, whilst FIG. 7*b* schematically shows a circuit configuration for driving different groups of actuators of inkjet printhead die 200.

Like numbering used previously will be used to describe like features as appropriate.

In the present embodiment, inkjet printhead die 200 is provided with droplet units 6*a*1-6*dn*, as previously described, and arranged in four rows (R1-R4), as also described above in relation to the inkjet printhead die of FIG. 2.

The inkjet printhead die 200 comprises multiple contacts 35*a*-35*n* arranged to provide signals (e.g. drive signals) to the first electrodes 28 of the respective actuators 22*a*1-22*dn* via electrical traces 32*a*.

In the illustrative example of FIG. 7*a*, eight electrical buses 137*a*-137*h* are depicted extending substantially extend in the direction of the row between the inner rows R2 & R3 of droplet units 6*b*1-6*cn*. It will be understood that the electrical buses 137*a*-137*d* are not limited to this particular configuration.

As described above, such a configuration allows for the actuators 22*a*1-22*dn* to be grouped, such that each group may be provided in common electrical communication with a specific electrical bus 137*a*-137*f*, whereby a controller (not shown) and/or drive circuit 38 (not shown in FIG. 7*a*), is used to provide the drive signals to the actuators of the different groups via the multiple contacts 35*a*-35*n*.

In the present embodiment, each row R1-R4 comprises two groups of actuators, whereby each group comprises alternate actuators of the respective rows.

FIG. 7*b* schematically shows four of the electrical buses 137*a-d* in electrical communication with actuators of rows R1 and R2.

For illustrative purposes, four different groups are labelled as A-D in FIG. 7*b*, whereby Each of the electrical buses is in common electrical communication with a respective group of actuators, whereby electrical buses 137*b* and 137*d* are in common electrical communication with alternate actuators of row R1 (Groups A & C); whilst electrical buses 137*a* and 137*c* are in common electrical communication with alternate actuators of row R2 (B & D).

The electrical buses may take any suitable form. For example, the electrical buses may comprise traces of conductive material deposited on the surface of the inkjet printhead die 200, or the electrical buses may be provided within a flexible cable.

Using such a configuration, each of the electrical buses may be used to provide a common signal (e.g. offset ground signals) to the actuators of the respective groups.

Grouping of the actuators 22*a*1-22*dn* and arranging each of the groups in common electrical communication with different electrical buses enables driving of the actuators of the different groups with reduced signal distortion, thereby providing a reduction in electrical crosstalk.

Also, the invention is not limited to four or eight electrical buses and any number of electrical buses may be provided.

Although the electrical buses are generally depicted as being provided centrally on the inkjet printhead dies of FIGS. 5*a* and 7*a* above, the invention is not limited to electrical buses arranged centrally on the printhead dies.

Furthermore, although the actuators of adjacent rows are generally shown to be arranged along the same axis in the width direction of the printhead dies, the actuators in adjacent rows may be offset with respect to each other along a width direction. Furthermore, actuators within the same row along the length of the die may be offset with respect to each other.

Whilst printhead dies having four rows of droplet units are described in the above embodiments, the invention is not limited to four rows, and any number of rows may be provided for example, from between one-ten rows, or more as required. It will further be appreciated that an inkjet printhead die may comprise any suitable number of droplet units, e.g. each row of the inkjet printhead die may comprise three hundred droplet units arranged to provide, for example, 300 nozzles per inch (NPI).

Alternatively the number of droplet units and/or rows may be increased, for example to provide a printhead die having up to 600 or 1200 NPI. The specific number of rows/droplet units provided on a printhead die may be dependent on application requirements and engineering constraints e.g. the size of the inkjet printhead die, size of the nozzles etc.

It will be appreciated that different groups may have different numbers of actuators. For example, a row of 300 actuators may comprise 4 groups of actuators whereby two groups have 100 actuators, a third group has 75 actuators, whilst a fourth group may have 25 actuators.

The present invention is not limited to the above described embodiments, and various modifications and improvements may be made within the scope of the present invention.

The invention claimed is:

1. An inkjet printhead comprising a printhead die, the printhead die comprising:

a plurality of actuators;

a plurality of electrical connections in discrete electrical communication with each respective first electrodes of the plurality of actuators for providing individual drive signals thereto;

a first electrical bus arranged in common electrical communication via respective electrical traces with second electrodes of a first group of the actuators for providing first signals thereto, the first electrical bus extending in a length direction of the printhead; and a second electrical bus arranged in common electrical communication via respective electrical traces with second electrodes of a second group of the actuators for providing second signals thereto, the second group being different from the first group, the second electrical bus extending in the length direction of the printhead, wherein the plurality of actuators are arranged in at least one row extending in the length direction of the inkjet printhead die, the at least one row comprises actuators from the first group and the second group, and actuators in the at least one row are arranged such that the second electrodes of the first group alternate with the second electrodes of the second group in the length direction.

2. An inkjet printhead according to claim 1, wherein the first group and the second group comprise alternate actuators of a row.

3. An inkjet printhead according to claim 1, wherein the first and second electrical buses are adjacent one another.

4. An inkjet printhead according to claim 1, wherein the first and second electrical buses extend along the length direction of the at least one row on a first side of the plurality of actuators, and the plurality of electrical connections is located at a second side of the plurality of actuators opposite to the first side.

5. An inkjet printhead according to claim 1, wherein the plurality of electrical connections are provided along a periphery of the inkjet printhead die.

6. An inkjet printhead according to claim 1, wherein the first and second electrical buses are in electrical communication with a controller remote from the printhead die, wherein the controller is configured to provide signals to the electrical buses.

7. An inkjet printhead according to claim 1, wherein the first and second electrical buses are electrically isolated from each other.

8. An inkjet printhead according to claim 1, wherein the first and second electrical buses are provided in electrical communication with a common connection, and the common connection has a lower resistance than that of the first and second electrical buses.

9. An inkjet printhead according to claim 1, wherein at least one of the first signals or the second signals comprise ground signals.

10. An inkjet printhead according to claim 1, further comprising a second plurality of actuators, a second plurality of electrical connections in discrete electrical communication with respective first electrodes of the second plurality of actuators for providing drive signals thereto, a third electrical bus arranged in common electrical communication via respective electrical traces with second electrodes of a third group of the actuators for providing third signals thereto, a fourth electrical bus arranged in common electrical communication via respective electrical traces with second electrodes of a fourth group of the actuators for providing fourth signals thereto, each electrical bus being in electrical communication with a different group of actuators, wherein the second plurality of actuators are arranged in one or more rows extending in a length direction of the inkjet printhead die, and the electrical buses are located adjacent one another and are located centrally between the two pluralities of actuators.

11. An inkjet printhead according to claim 1, wherein the first and second electrical buses comprise traces of conductive material deposited on the surface of the printhead die.

12. An inkjet printhead according to claim 1, further comprising a plurality of electrical contacts coupled to the plurality of electrical connections.

13. An inkjet printhead according to claim 12, wherein the plurality of electrical contacts are in electrical communication with a controller; and the plurality of electrical contacts are provided in two rows on the printhead die along two opposing sides.

14. An inkjet printhead comprising a printhead die, the printhead die comprising:

a first and a second plurality of actuators;

a plurality of electrical connections in discrete electrical communication with respective first electrodes of the first and second plurality of actuators for providing individual drive signals thereto;

two or more electrical buses, each being in common electrical communication via respective electrical traces with second electrodes of respective groups of the actuators for providing respective signals thereto, each extending in a length direction of the printhead;

wherein one or more of the plurality of electrical communications are arranged along a periphery of the printhead die, each plurality of actuators is arranged in one or more rows extending in a length direction of the printhead die, the two or more electrical buses are arranged adjacent one another and located centrally between the first and second plurality of actuators, each row comprises at least two groups of actuators, and actuators in each row are arranged such that the second electrodes of respective groups alternate in the length direction.

15. The inkjet printhead according to claim 14, wherein each respective group comprises alternate actuators of a row.

16. A printhead die for an inkjet printhead, the printhead die comprising:

a plurality of actuators;

a plurality of electrical connections in discrete electrical communication with respective first electrodes of the plurality of actuators for providing individual drive signals thereto;

a first electrical bus arranged in common electrical communication via respective electrical traces with second electrodes of a first group of the actuators for providing first signals thereto, the first electrical bus extending in a length direction of the printhead; and a second electrical bus arranged in common electrical communication via respective electrical traces with second electrodes of a second group of the actuators for providing second signals thereto, the second group being different from the first group, the second electrical bus extending in the length direction of the printhead, wherein the plurality of actuators are arranged in at least one row extending in the length direction of the inkjet printhead die, the at least one row comprises actuators from the first group and the second group, and actuators in the at least one row are arranged such that the second electrodes of the first group alternate with the second electrodes of the second group in the length direction.

17. The printhead die according to claim 16, further comprising:

a second plurality of actuators, a second plurality of electrical connections in discrete electrical communication with respective first electrodes of the second plurality of actuators for providing drive signals thereto, a third electrical bus arranged in common electrical communication via respective electrical traces with second electrodes of a third group of the actuators for providing third signals thereto, a fourth electrical bus arranged in common electrical communication via respective electrical traces with second electrodes of a fourth group of the actuators for providing fourth signals thereto, each electrical bus being in electrical communication with a different group of actuators, wherein the second plurality of actuators are arranged in one or more rows extending in a length direction of the inkjet printhead die, and wherein the electrical buses are located adjacent one another and are located centrally between the two pluralities of actuators.

18. The printhead die according to claim 17, wherein each row of the second plurality of actuators comprises at least two groups of actuators.

19. The printhead die according to claim 17, wherein the first to fourth electrical buses extend along the length direction of the die.

20. The printhead die according to claim 17, wherein the plurality of electrical connections are provided along a periphery of the inkjet printhead die.

* * * * *